US010168031B2

(12) United States Patent
Boulanger et al.

(10) Patent No.: US 10,168,031 B2
(45) Date of Patent: Jan. 1, 2019

(54) LIGHTING ARRANGEMENT

(71) Applicant: CP IP Holdings Limited, Central Hong Kong (CN)

(72) Inventors: Dave Boulanger, Hong Kong (CN); Maciej Nowakowski, Hong Kong (CN)

( * ) Notice: Subject to any disclaimer, the term of this patent is extended or adjusted under 35 U.S.C. 154(b) by 517 days.

(21) Appl. No.: 14/956,416

(22) Filed: Dec. 2, 2015

(65) Prior Publication Data

US 2016/0161096 A1 Jun. 9, 2016

Related U.S. Application Data

(60) Provisional application No. 62/086,820, filed on Dec. 3, 2014.

(51) Int. Cl.
*F21V 17/00* (2006.01)
*F21V 21/02* (2006.01)
(Continued)

(52) U.S. Cl.
CPC ..... *F21V 21/02* (2013.01); *F21V 17/005* (2013.01); *F21V 17/14* (2013.01); *F21V 21/14* (2013.01);
(Continued)

(58) Field of Classification Search
CPC ..... F01N 13/008; F01N 13/102; G01J 5/08; G09F 3/0294; G09F 13/20; B82Y 20/00; B82Y 40/00; Y10S 977/774; Y10S 977/813; Y10S 977/892; Y10S 977/95; Y10S 977/955
See application file for complete search history.

(56) References Cited

U.S. PATENT DOCUMENTS 6,082,871 A 7/2000 Yeh
6,474,846 B1 11/2002 Kelmelis et al.
(Continued)

FOREIGN PATENT DOCUMENTS

CA 2586494 A1 10/2007
CA 2754514 A1 4/2012
(Continued)

OTHER PUBLICATIONS

Communication Issued by European Patent Office in Corresponding Application 15197462.3-1757; dated Apr. 6, 2016.
(Continued)

*Primary Examiner* — Anh Mai
*Assistant Examiner* — Fatima Farokhrooz

(57) ABSTRACT

A lighting arrangement can include a mounting ring and a luminaire. The mounting ring can extend along a central longitudinal axis and have a plurality of tabs, a circular wall, and a plurality of locking arms. Each of the plurality of tabs can define a mounting aperture and the circular wall can interconnect the plurality of tabs. Each of the plurality of locking arms can project from the circular wall and include a circumferential portion extending about the axis. The luminaire can have a housing assembly and a light emitter and a plurality of posts. The mounting ring and the luminaire can be interconnected by moving the posts past distal ends of the locking arms along the axis and then rotating the mounting ring and the luminaire relative to one another in a first angular direction about the axis.

20 Claims, 9 Drawing Sheets

(51) Int. Cl.

| | |
|---|---|
| ***F21V 17/14*** | (2006.01) |
| ***F21V 21/14*** | (2006.01) |
| *F21S 8/02* | (2006.01) |
| *F21V 21/04* | (2006.01) |
| *F21Y 115/10* | (2016.01) |

(52) U.S. Cl.
CPC ..... *F21S 8/024* (2013.01); *F21S 8/026* (2013.01); *F21V 21/04* (2013.01); *F21Y 2115/10* (2016.08)

(56) References Cited

U.S. PATENT DOCUMENTS

| | | | | |
|---|---|---|---|---|
| 7,273,983 | B1 | 9/2007 | Rintz | |
| 8,333,491 | B1 | 12/2012 | Chou et al. | |
| 8,376,777 | B2 | 2/2013 | Smith | |
| 2007/0253204 | A1* | 11/2007 | Akinrele | F21V 15/04 362/362 |
| 2008/0278958 | A1 | 11/2008 | Jiang | |
| 2009/0203260 | A1 | 8/2009 | Vogt et al. | |
| 2009/0213595 | A1 | 8/2009 | Alexander et al. | |
| 2010/0091484 | A1 | 4/2010 | Mayfield et al. | |
| 2010/0177482 | A1* | 7/2010 | Spivey | H05K 7/20445 361/710 |
| 2011/0032723 | A1* | 2/2011 | Gerhard | F21S 48/1104 362/538 |
| 2012/0187852 | A1 | 7/2012 | Mandy et al. | |
| 2012/0261992 | A1 | 10/2012 | Parker et al. | |
| 2012/0268894 | A1 | 10/2012 | Alexander et al. | |
| 2013/0033872 | A1* | 2/2013 | Randolph | F21V 29/004 362/294 |
| 2013/0141890 | A1* | 6/2013 | Carlin | F21V 23/026 362/20 |
| 2013/0153731 | A1 | 6/2013 | Engstrom et al. | |
| 2013/0342342 | A1 | 12/2013 | Sabre et al. | |
| 2014/0071687 | A1 | 3/2014 | Tickner et al. | |
| 2014/0092606 | A1 | 4/2014 | Potucek et al. | |
| 2014/0092608 | A1 | 4/2014 | Moser et al. | |
| 2014/0268768 | A1 | 9/2014 | Holland et al. | |
| 2016/0230973 | A1 | 8/2016 | Shaw | |

FOREIGN PATENT DOCUMENTS

| | | | |
|---|---|---|---|
| CA | 2766601 | A1 | 6/2013 |
| DE | 4030077 | A1 | 3/1992 |
| EP | 3029369 | A1 | 6/2016 |
| GB | 2500797 | A | 10/2013 |
| JP | 2010287459 | A | 12/2010 |
| KR | 100985710 | B1 | 10/2010 |
| WO | 2013058060 | A1 | 4/2013 |
| WO | 2013175233 | A2 | 11/2013 |

OTHER PUBLICATIONS

European Search Report for application No. 16150077.2, dated May 23, 2016, 10 pgs.
Extended European Search Report for Application No. 16275119.2 dated Feb. 13, 2017.
Extended European Search Report for Application No. 16275120.0 dated Feb. 14, 2017.

* cited by examiner

LIGHTING ARRANGEMENT

CROSS-REFERENCE TO RELATED APPLICATIONS

This application claims the benefit of U.S. Provisional Patent Application Ser. No. 62/086,820 for a LIGHTING ARRANGEMENT, filed on 3 Dec. 2014, which is hereby incorporated by reference in its entirety.

BACKGROUND

1. Field

The present disclosure relates to structures operable to emit light.

2. Description of Related Prior Art

U.S. Pat. No. 8,376,777 discloses a QUICK MOUNTING DEVICE WITH MODULES. The quick mounting device for appliances is alleged to be quickly and easily engaged and disengaged mechanically without the use of tools.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A lighting arrangement can include a mounting ring and a luminaire. The mounting ring can extend along a central longitudinal axis and have a plurality of tabs. The mounting ring can also have a circular wall and a plurality of locking arms. Each of the plurality of tabs can define a mounting aperture. The circular wall can interconnect the plurality of tabs. The circular wall can have an inwardly-facing surface encircling the axis and defining a cavity. The circular wall can also have an outwardly-facing surface opposite the inwardly-facing surface with a thickness defined between the inwardly-facing surface and the outwardly-facing surface. The circular wall can extend a height along the axis between a downwardly-facing surface and an upwardly-facing surface. Each of the plurality of locking arms can project from the circular wall radially relative to the axis. Each of the plurality of locking arms can include a vertical portion extending along the axis and a circumferential portion extending about the axis. Each of the circumferential portions can extend from a first end at an intersection with one of the vertical portions to a respective second end distal relative to the first end. Each of the circumferential portions can have an upper face and a lower face. The luminaire can have a housing assembly and a light emitter and a plurality of posts. The housing assembly can at least partially enclose the light emitter. The housing assembly can at least partially be received in the cavity. Each of the plurality of posts can extend away from the housing assembly. The mounting ring and the luminaire can be interconnected by moving each of the plurality posts past each of the plurality of distal ends along the axis and rotating the mounting ring and the luminaire relative to one another in a first angular direction about the axis.

BRIEF DESCRIPTION OF THE DRAWINGS

The detailed description set forth below references the following drawings.

DETAILED DESCRIPTION

Figure 1:
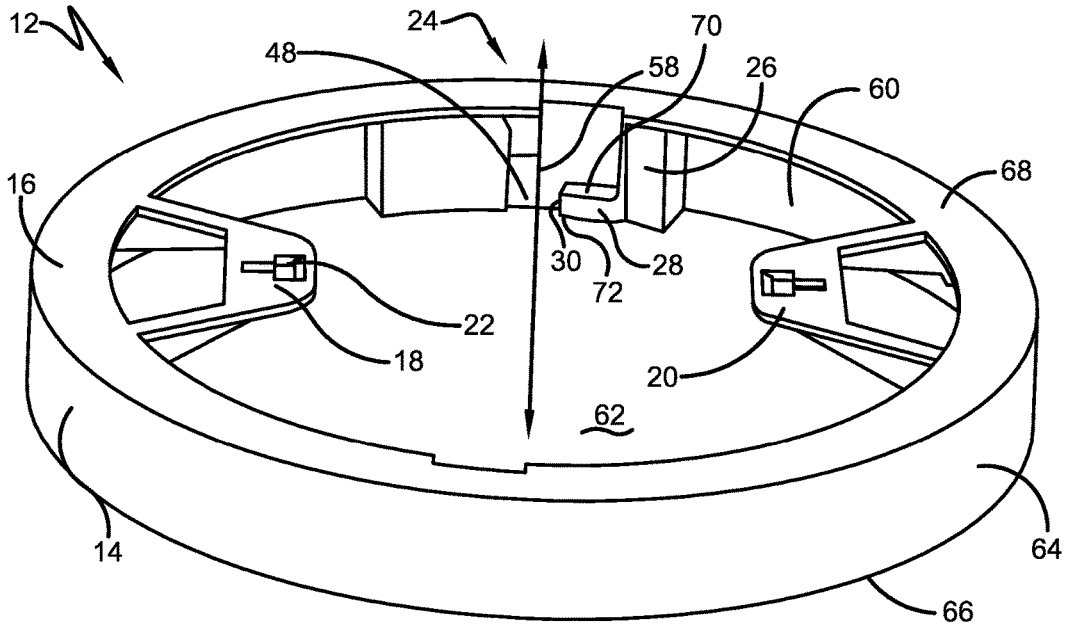
FIG. 1 is a perspective view of a mounting ring according to an exemplary embodiment of the present disclosure.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The present disclosure, as demonstrated by the exemplary embodiments described below, can provide lighting arrangements that do not require an installer to make additional holes into the ceiling or wall mounting location. Lighting arrangements according to one or more embodiments of the present disclosure can attach directly into a standard junction box used in building construction. Lighting arrangements according to one or more embodiments of the present disclosure can be comprised of two main components that are attached together without the need for tools.

FIG. 1 is a perspective view of a mounting ring 12 according to an exemplary embodiment of the present disclosure. The mounting ring 12 can include a cylindrical portion or circular wall 14 and a disk portion 16. Mounting tabs projections 18, 20 can be engaged with the cylindrical portion 14 and the disk portion 16. The circular wall 14 can interconnect the plurality of tabs 18. Each mounting projection 18, 20 can include a mounting aperture, such as aperture 22, configured to receive a threaded fastener for attaching the mounting ring 12 to a junction box (not shown). The circular wall 14 can have an inwardly-facing surface 60 encircling the axis 58 and defining a cavity 62. The circular wall 14 can also have an outwardly-facing surface 64 opposite the inwardly-facing surface 60 with a thickness defined between the inwardly-facing surface 60 and the outwardly-facing surface 64. The circular wall 14 can extend a height along the axis 58 between a downwardly-facing surface 66 and an upwardly-facing surface 68.

The mounting ring 12 can also include one or more locking arms 24. The exemplary locking arms 24 projecting radially-inward from the inwardly-facing surface 60 of the cylindrical portion 14. The locking arm 24 can include a vertical portion 26 and a circumferential portion 28. Each of the plurality of circumferentially-extending locking arms 24 can project from the circular wall 14 radially relative to the axis 58. Each of the circumferential portions 28 can extend from a first end at an intersection with one of the vertical portions 26 to a respective second end 30 distal relative to the first end. Each of the circumferential portions 28 can have an upper face 70 and a lower face 72. Each face 70, 72 can be defined by a plurality of discrete surfaces in one or more implementations of the present disclosure.

Figure 2:
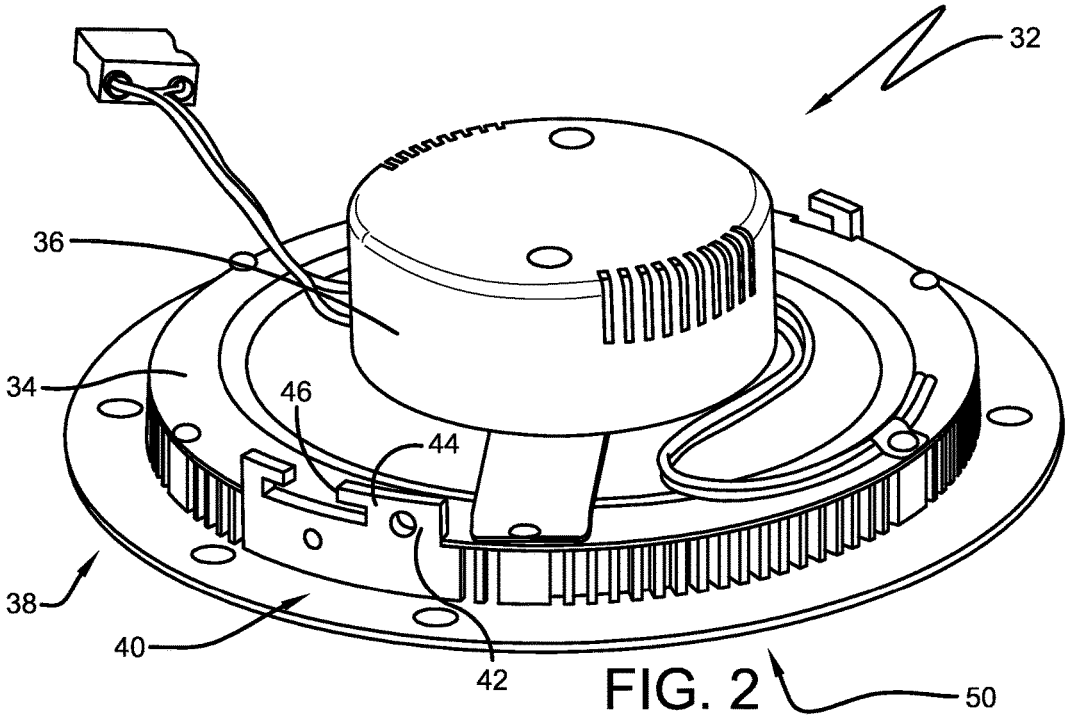
FIG. 2 is a perspective view of a lighting assembly according to an exemplary embodiment of the present disclosure.

FIG. 2 is a perspective view of a lighting assembly or luminaire 32 according to an exemplary embodiment of the present disclosure. The lighting assembly 32 can include a housing assembly 34 containing light emitters and circuitry for powering the light emitters, including any power and ac/dc conversion circuitry. The circuitry can be mounted in a housing 36 attached to the housing assembly 34. The housing assembly 34 can also include a plurality of posts 40. Each of the plurality of posts 40 can extend away from the housing assembly 34. The housing 36 can be sized to fit within a junction box. The housing assembly 34 can be sized to at least partially be received in the cavity 62.

The plate 34 and housing 36 can be interconnected to one another through a covering ring 38 of the exemplary lighting assembly 32. The covering ring 38 define the posts 40. Each of the exemplary posts 40 can have a vertical portion 42 and a circumferential portion 44. The circumferential portion 44 projects transverse to the vertical portion 42 to a distal end 46.

After the mounting ring 12 has been mounted at the desired location for lighting, the lighting assembly 32 can be received in the cylindrical portion 14 to form a lighting arrangement. The mounting ring 12 and the luminaire 32 can be interconnected by moving each of the plurality posts 40 past each of the plurality of distal ends 30 along the axis 58 and rotating the mounting ring 12 and the luminaire 32 relative to one another in a first angular direction about the axis 58. The vertical portion 44 can be received in a gap referenced at 48. The lighting assembly 32 can then be rotated relative to the mounting ring 12 until the distal end 46 contacts the vertical portion 26 and/or until the distal end 30 contacts the vertical portion 42. The mounting ring 12 and the lighting assembly 32 are thus assembled for use and an exemplary lighting arrangement is formed. A surface referenced at 50 of the covering ring 38 conceals the mounting ring 12 from view.

Figure 3:
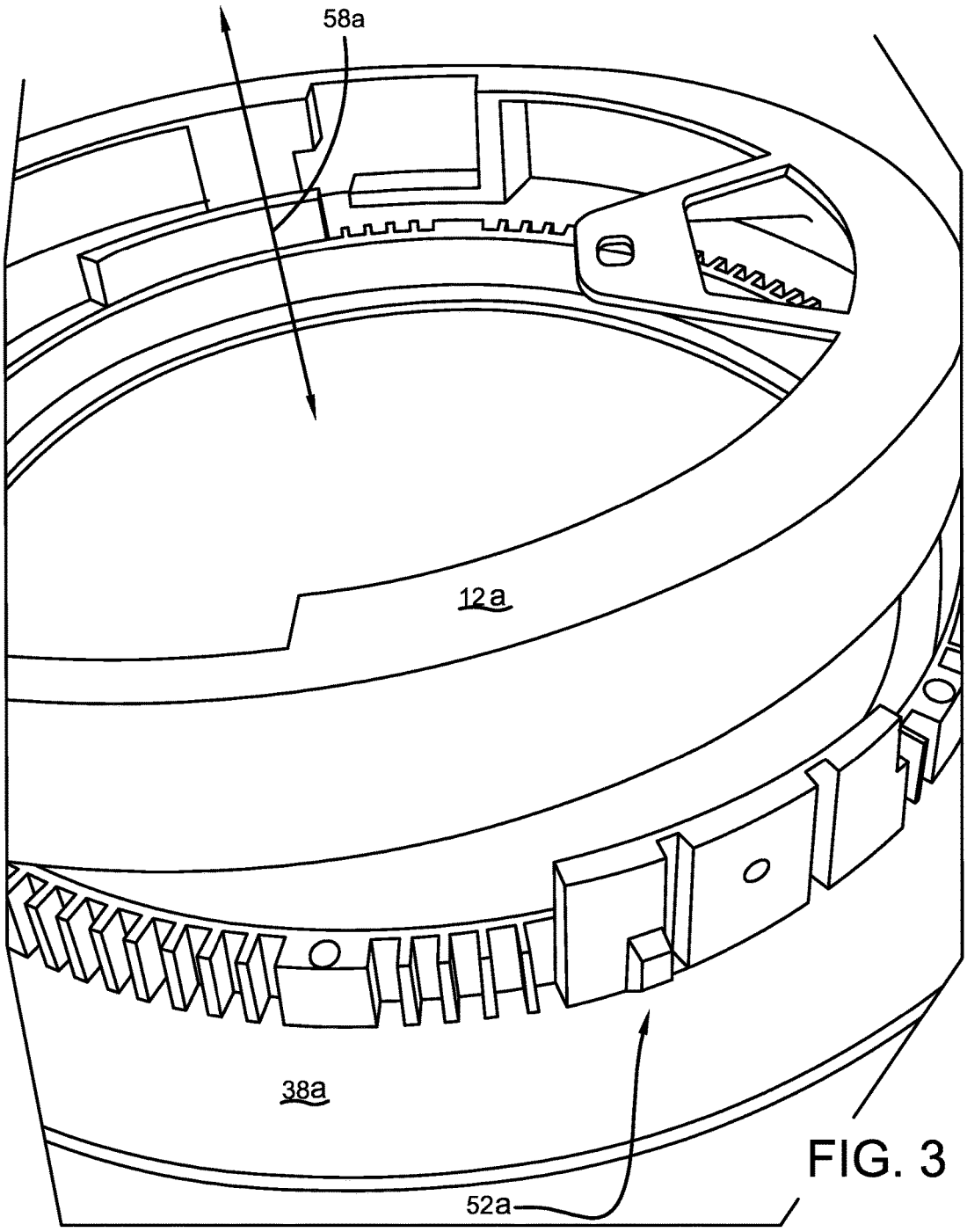
FIG. 3 is a perspective view of a mounting ring and covering ring according to an exemplary embodiment of the present disclosure.

FIG. 3 is a perspective view of a mounting ring 12*a* and a covering ring 38*a* according to an exemplary embodiment of the present disclosure. The hook portion 40 has been replaced with a hook portion 40*a* in the form of a tab. The hook portion 40*a* extends radially outward relative to an axis 58*a*, rather than along the axis 58 like the hook portion 40.

Figure 4:
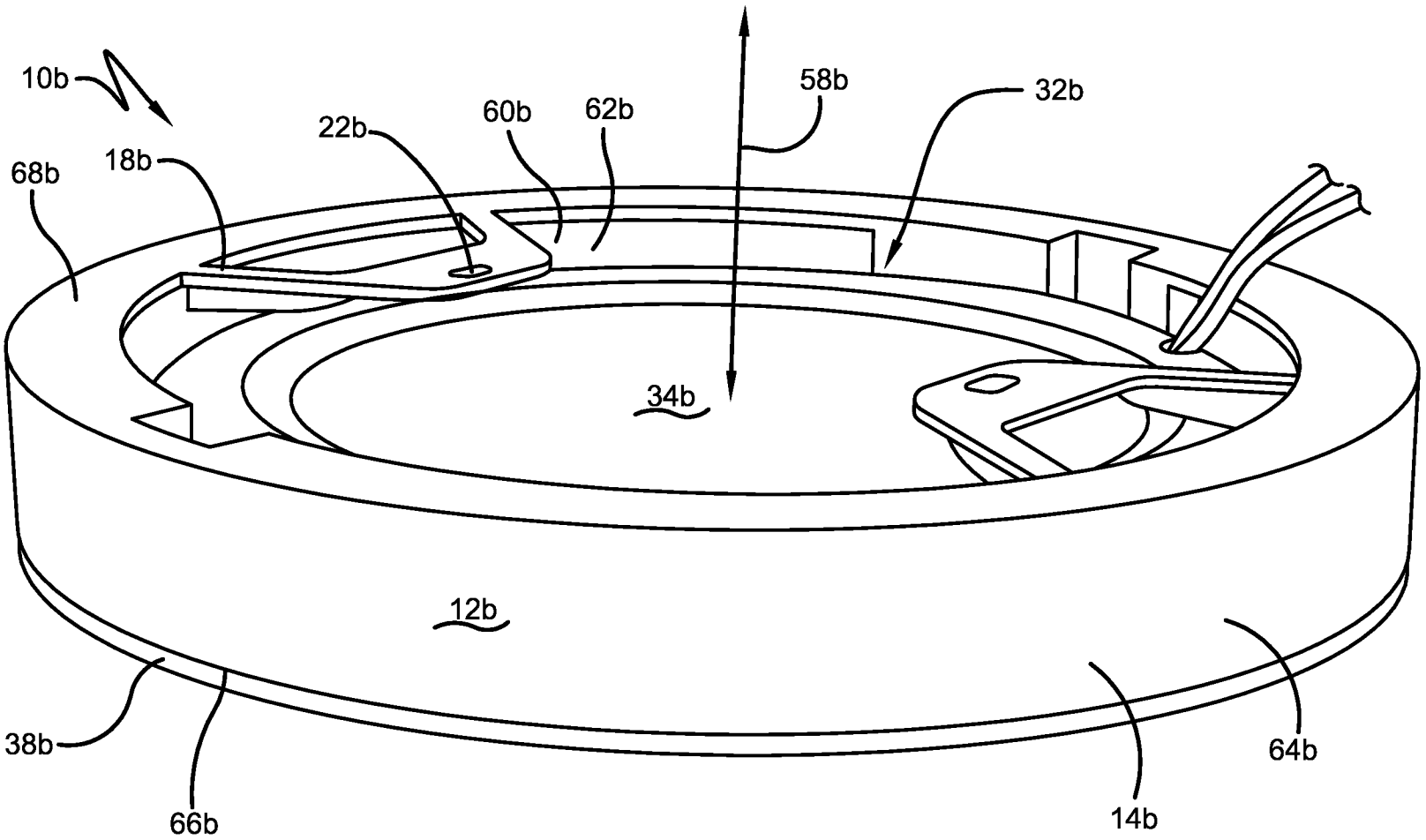
FIG. 4 is a perspective view of a lighting arrangement according to an exemplary embodiment of the present disclosure.

FIG. 4 is a perspective view of a lighting arrangement 10*b* according to an exemplary embodiment of the present disclosure. The lighting arrangement 10*b* includes a mounting ring 12*b*. A covering ring 38*b* is also illustrated. The lighting arrangement 10*b* includes an alternative housing assembly 34*b* that does not protrude above the mounting ring 12*b*. The housing assembly 34*b* can include all of the components contained in the housing assembly 36 and the housing 36 of the first embodiment.

Figure 6:
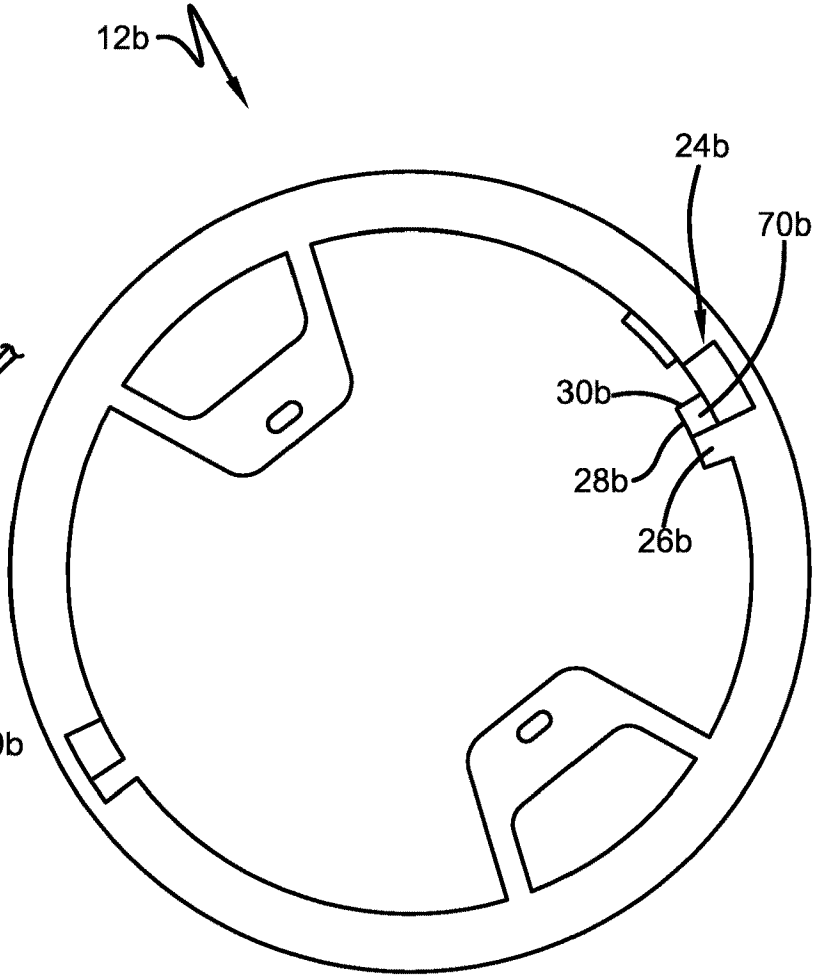
FIG. 6 is a top view of a mounting ring according to an exemplary embodiment of the present disclosure.
Figure 5:
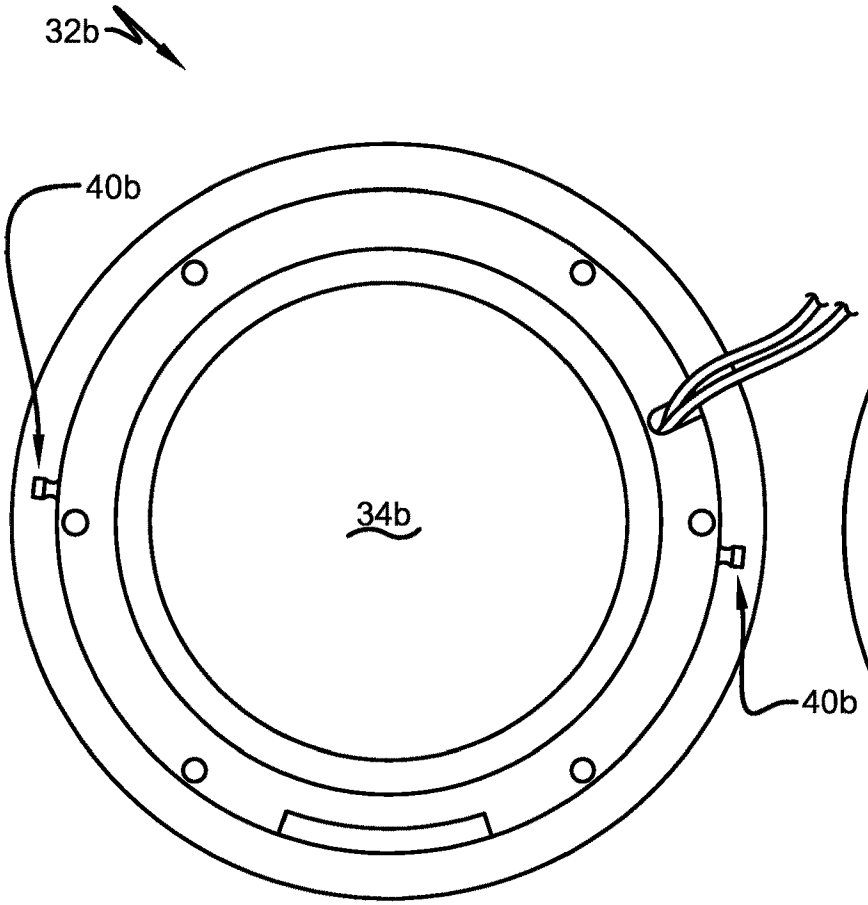
FIG. 5 is a top view of a lighting assembly according to an exemplary embodiment of the present disclosure.

FIG. 5 is a top view of a lighting assembly 32*b* according to an exemplary embodiment of the present disclosure. The exemplary lighting assembly 32*b* is a component of the exemplary lighting arrangement 10*b* shown in FIG. 4. FIG. 6 is a top view of the mounting ring 12*b* according to an exemplary embodiment of the present disclosure.

With reference to FIGS. 4-6, the mounting ring 12*b* can extend along a central longitudinal axis 58*b* and have a plurality of tabs, such as tab 18*b*. The mounting ring 12*b* can also have a circular wall 14*b* and a plurality of locking arms 24*b*. Each of the plurality of tabs 18*b* can define a mounting aperture, such as mounting aperture 22*b*. The circular wall 14*b* can interconnect the plurality of tabs 18*b*. The circular wall 14*b* can have an inwardly-facing surface 60*b* encircling the axis 58*b* and defining a cavity 62*b*. The circular wall 14*b* can also have an outwardly-facing surface 64*b* opposite the inwardly-facing surface 60*b* with a thickness defined between the inwardly-facing surface 60*b* and the outwardly-facing surface 64*b*. The circular wall 14*b* can extend a height along the axis 58*b* between a downwardly-facing surface 66*b* and an upwardly-facing surface 68*b*. Each of the plurality of circumferentially-extending locking arms 24*b* can project from the circular wall 14*b* radially relative to the axis 58*b*. Each of the plurality of locking arms 24*b* can include a vertical portion 26*b* extending along the axis 58*b* and a circumferential portion 28*b* extending about the axis 58*b*. Each of the circumferential portions 28*b* can extend from a first end at an intersection with one of the vertical portions 26*b* to a respective second end 30*b* distal relative to the first end. Each of the circumferential portions 28*b* can have an upper face 70*b* and a lower face (not visible in FIGS. 4-6). Each face can be defined by a plurality of discrete surfaces in one or more implementations of the present disclosure. The luminaire 32*b* can include the housing assembly 34*b*, one or more light emitters (not visible), and a plurality of posts 40*b*. The housing assembly 34*b* can at least partially enclose the light emitter. The exemplary housing assembly 34*b* can be fully received in the cavity 62*b*. Each of the plurality of posts 40*b* can extend away from the housing assembly 34*b*. The mounting ring 12*b* and the luminaire 32*b* can be interconnected by moving each of the plurality posts 40*b* past each of the plurality of distal ends 30*b* along the axis 58*b* and rotating the mounting ring 12*b* and the luminaire 32*b* relative to one another in a first angular direction about the axis 58*b*.

Figures 7, 8:
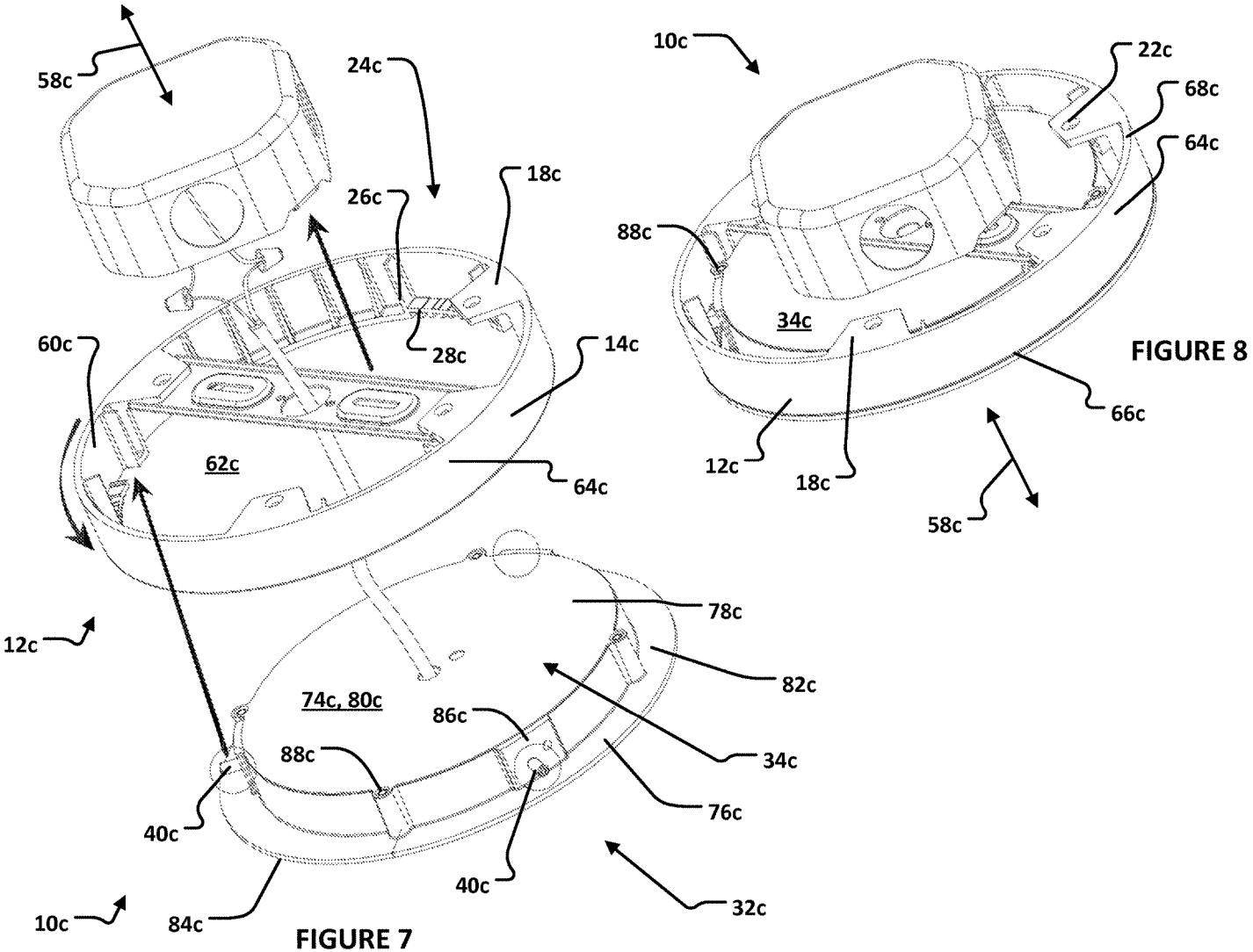
FIG. 7 is an exploded view of an exemplary embodiment of the present disclosure.
FIG. 8 is a perspective assembly view the exemplary embodiment of the present disclosure shown in FIG. 7.
Figure 9:
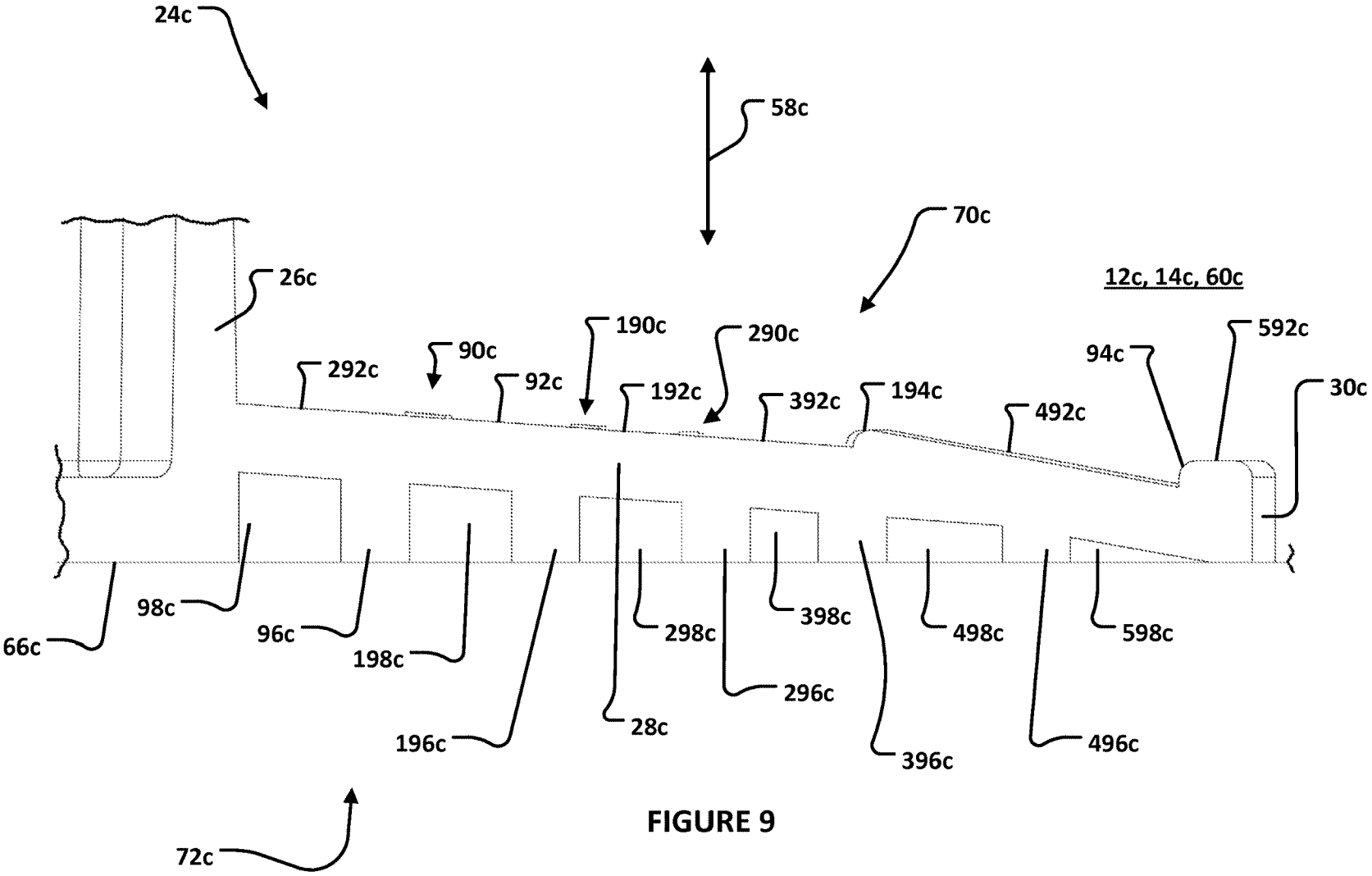
FIG. 9 is a planar view of a locking arm of the exemplary embodiment of the present disclosure shown in FIG. 7 from the perspective of a central longitudinal axis.

In other embodiment of the present disclosure, shown in FIGS. 7-9, a lighting arrangement 10*c* can include a mounting ring 12*c* and a luminaire 32*c*. The mounting ring 12*c* can extend along a central longitudinal axis 58*c* and have a plurality of tabs 18*c*. The mounting ring 12*c* can also have a circular wall 14*c* and a plurality of locking arms 24*c*. Each of the plurality of tabs 18*c* can define a mounting aperture 22*c*. The circular wall 14*c* can interconnect the plurality of tabs 18*c*. The circular wall 14*c* can have an inwardly-facing surface 60*c* encircling the axis 58*c* and defining a cavity 62*c*. The circular wall 14*c* can also have an outwardly-facing surface 64*c* opposite the inwardly-facing surface 60*c* with a thickness defined between the inwardly-facing surface 60*c* and the outwardly-facing surface 64*c*. The circular wall 14*c* can extend a height along the axis 58*c* between a downwardly-facing surface 66*c* and an upwardly-facing surface 68*c*.

As best shown in FIG. 9, each of the plurality of circumferentially-extending locking arms 24*c* can project from the circular wall 14*c* radially relative to the axis 58*c*. The exemplary arms 24*c* project radially inward, but could project radially outward in other implementations of the present disclosure. Each of the plurality of locking arms 24*c* can include a vertical portion 26*c* extending along the axis 58*c* and a circumferential portion 28*c* extending about the axis 58*c*. Each of the circumferential portions 28*c* can extend from a first end at an intersection with one of the vertical portions 26*c* to a respective second end 30*c* distal relative to the first end. Each of the circumferential portions 28*c* can have an upper face 70*c* and a lower face 72*c*. Each face 70*c*, 72*c* can be defined by a plurality of discrete surfaces in one or more implementations of the present disclosure.

The luminaire 32*c* can have a housing assembly 34*c* and a light emitter and a plurality of posts 40*c*. The housing assembly 34*c* can at least partially enclose the light emitter. The exemplary housing assembly 34*c* can be fully received in the cavity 62*c*. Each of the plurality of posts 40*c* can extend away from the housing assembly 34*c*. The mounting ring 12*c* and the luminaire 32*c* can be interconnected by moving each of the plurality posts 40*c* past each of the plurality of distal ends 30*c* along the axis 58*c* and rotating the mounting ring 12*c* and the luminaire 32*c* relative to one another in a first angular direction about the axis 58*c*.

The exemplary housing assembly 34*c* can include a body portion 74*c* having a covering ring or flange portion 76*c*. The body portion 74*c* can extend between top end 78*c* and a bottom end along the axis 58*c*. The exemplary body portion 74*c* is fully disposed in the cavity 62*c*. The body portion 74*c* can extend along the axis 58*c* between the downwardly-facing surface 66*c* of the circular wall 14*c* and the plurality of tabs 18*c*. The body portion 74*c* can have a variable thickness, with thicker portions (such as referenced at 86*c*) surrounding each of the plurality of posts 40*c*. The flange portion 76*c* can extend radially-outward from the body portion 74*c* and having an upwardly-facing surface 82*c* and a downwardly-facing surface 84*c*. The upwardly-facing surface 82*c* of the flange portion 76*c* can abut and contact the downwardly-facing surface 66*c* of the circular wall 14*c* around a continuous circumference about the axis 58*c*, as shown in FIG. 8. A diameter of the flange portion 76*c* can be substantially equal to a diameter of the outwardly-facing surface 64*c* of the circular wall 14*c* and thus flush with the outwardly-facing surface 64*c*.

The exemplary housing assembly 34*c* can also include a canister portion 80*c* positioned in the body portion 74*c*. The light emitters can be disposed in the canister portion 80*c*. The canister portion 80*c* and the body portion 74*c* can be interconnected with fasteners 88*c*.

FIG. 9 is a planar view of the locking arm 24*c* from the perspective of the central longitudinal axis 58*c*. As shown, the exemplary upper face 70*c* defines a serrated profile. The illustration of the profile 24*c* shows a series of notched edges, a plurality of distinct surfaces delineated by distinct edges. The exemplary edges are defined by a plurality of protuberances 90*c*, 190*c*, 290*c*, with planar surface portions 92*c*, 192*c* defined between adjacent pairs of protuberances and other planar surface portions 292*c*, 392*c*, 492*c*, 592*c*.

The posts 40*c* can ride along the upper face 70*c* during assembly of the lighting arrangement 10*c*. The engagement between the posts 40*c* and the protuberances 90*c*, 190*c*, 290*c* and the surfaces 92*c*, 192*c*, 292*c*, 392*c*, 492*c*, 592*c* provide the assembler (typically a consumer) during relative rotation between the lighting arrangement 32*c* and the mounting ring 12*c*, allows the assembler to feel progress of assembly. Further, the arrangement of the protuberances 90*c*, 190*c*, 290*c* and the surfaces 92*c*, 192*c*, 292*c*, 392*c*, 492*c*, 592*c* allow the lighting arrangement 32*c* to be positioned in a plurality of different angular positions relative to the mounting ring 12*c*. In the Figures, the lighting arrangement 32*c* is unadorned, but embodiments can be practiced with decorative features and indicia and a precise angular of the lighting arrangement 32*c* relative to the mounting ring 12*c* can be desirable. Engagement between the posts 40*c* and the protuberances 90*c*, 190*c*, 290*c* can generate a click or another noise so that the assembler is advised of progress or advised of one possible "final" position for the lighting arrangement 32*c*. For example, the first click can inform the assembler that the lighting arrangement 32*c* is acceptably engaged with the mounting ring 12*c*. The assembler can further rotate the lighting arrangement 32*c* if desired. Embodiments can include more than three protuberances 90*c*, 190*c*, 290*c*. The gaps between protuberances 90*c*, 190*c*, 290*c* (the circumference length of the surface portions 92*c*, 192*c*) can be constant or variable. For example, the gaps can shorten as rotation of the lighting arrangement 32*c* progresses. The protuberances 90*c*, 190*c*, 290*c* also define a circumferential length as well, as shown in FIG. 9. As also shown in FIG. 9, the circumferential lengths of the surface portions 92*c*, 192*c*, 292*c*, 392*c* are each greater than the circumferential lengths of any of the protuberances 90*c*, 190*c*, 290*c*.

The upper face 70*c* can also include a plurality of surface portions 94*c*, 194*c* that are concave relative to the first angular direction. In other words, the plurality of surface portions 94*c*, 194*c* are convex relative to the second angular direction. The direction of assembly rotation for an exemplary embodiment, the first angular direction, is referenced at 96*c*. As shown in FIG. 9, the concave surface portions 94*c*, 194*c* can be positioned on the upper face 70*c* spaced from the plurality of protuberances 90*c*, 190*c*, 290*c* in a second angular direction about the central longitudinal axis 58*c* that is opposite to the first angular direction 96*c*. FIG. 9 also shows that the concave surface portions 94*c*, 194*c* can be shaped differently than the plurality of protuberances 90*c*, 190*c*, 290*c*. Specifically, in one or more embodiments, the mounting ring 12*c* can be fixed and the lighting arrangement 32*c* can be rotated in the direction 96*c* to engage the lighting arrangement 32*c* with the mounting ring 12*c*. The post 40*c* can ride along the surface portion 592*c* of the upper face 70*c* during assembly of the lighting arrangement 10*c* and ride over the 94*c* which is concave relative to the direction 96*c*. The movement of the post 40*c* over the surface portion 94*c* can generate a pronounced click or hand-feel. The concave surface portions 94*c*, 194*c* along with the protuberances 90*c*, 190*c*, 290*c* can cause different noises or tactile sensations that can assist the assembler during assembly. The surface portion 94*c* is fed by the flat surface portion 592*c*. The surface portion 194*c* is fed by the ramp surface portion 492*c*. Thus, order of flat and concave surface portions can be varied to simplify installation for the assembler.

The lower face 72*c* of the locking arm 24*c* defines a stepped profile. The stepped profile includes a plurality of steps 96*c*, 196*c*, 296*c*, 396*c*, 496*c* and a plurality of gaps 98*c*, 198*c*, 298*c*, 398*c*, 498*c*, 598*c* between adjacent steps. The circumferential width of the steps 96*c*, 196*c*, 296*c*, 396*c*, 496*c* can be variable or constant. The circumferential width of the gaps 98*c*, 198*c*, 298*c*, 398*c*, 498*c*, 598*c* can be variable or constant. It can be desirable to vary the circumferential widths in that variation can provide an indication of the distal end 30 for the assembler. The mounting ring 12*c* can be installed in a wall or ceiling and the pattern of steps and gaps can provide an indication to the assembler of the location of the locking arms 24*c*. In the exemplary embodiment, the widths of gaps 498*c* and 598*c* are greater than the width of gaps 98*c*, 198*c*, 298*c*, and 398*c*. Further the width of gap 398*c* is less than the widths of the remaining gaps 198*c*, 298*c*, 398*c*, 498*c*, 598*c*. The mounting ring 12*c* can be formed such that downwardly-facing surface 66*c* is planar and uninterrupted except for the pattern of gaps 98*c*, 198*c*, 298*c*, 398*c*, 498*c*, 598*c* to assist the assembler in quickly and easily identifying the location for inserting the posts 40*c*.

The arrangement of the steps 96*c*, 196*c*, 296*c*, 396*c*, 496*c* and the gaps 98*c*, 198*c*, 298*c*, 398*c*, 498*c*, 598*c* renders the thickness of the plurality of locking arms 24, as defined along the axis 58*c*, to be variable. This allows for some bending of the locking arm 24*c* during installation. Bending of the locking arm 24*c* can enhance the tactile or noise response when the posts 40*c* engage features of the upper face 70*c*.

Figure 10:
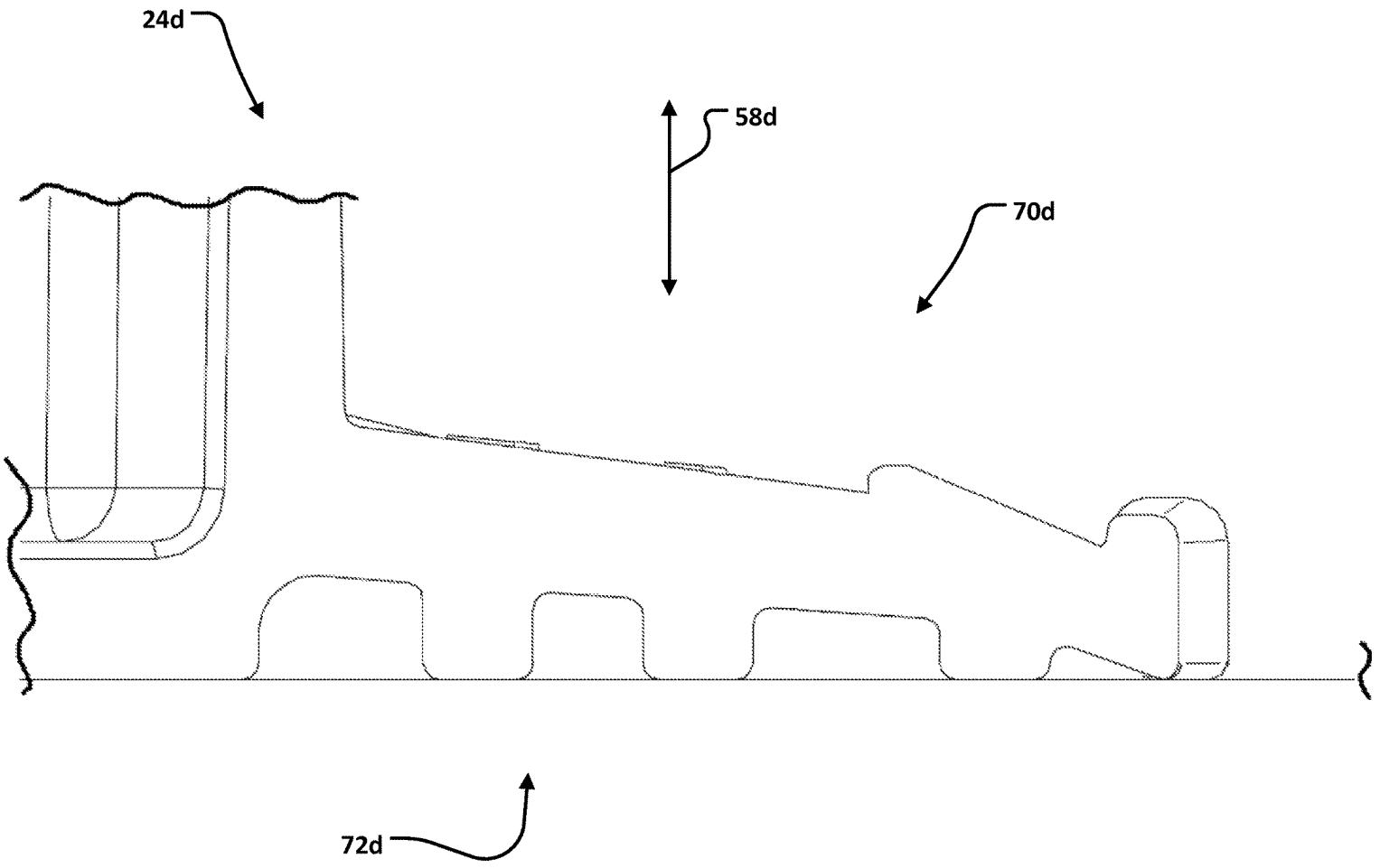
FIG. 10 is a planar view of a locking arm of another exemplary embodiment of the present disclosure.

FIG. 10 is a planar view of a locking arm 24*d* of another exemplary embodiment of the present disclosure from the perspective of a central longitudinal axis 58*d*. The locking arm 24*d* includes an upper face 70*d* and a lower face 72*d*. The upper face 70*d* defines a plurality of discreet planar surfaces with edges defined between the surfaces. The locking arm 24*d* defines a more compact upper face 70*d* than the upper face 70*c*.

Figure 11:
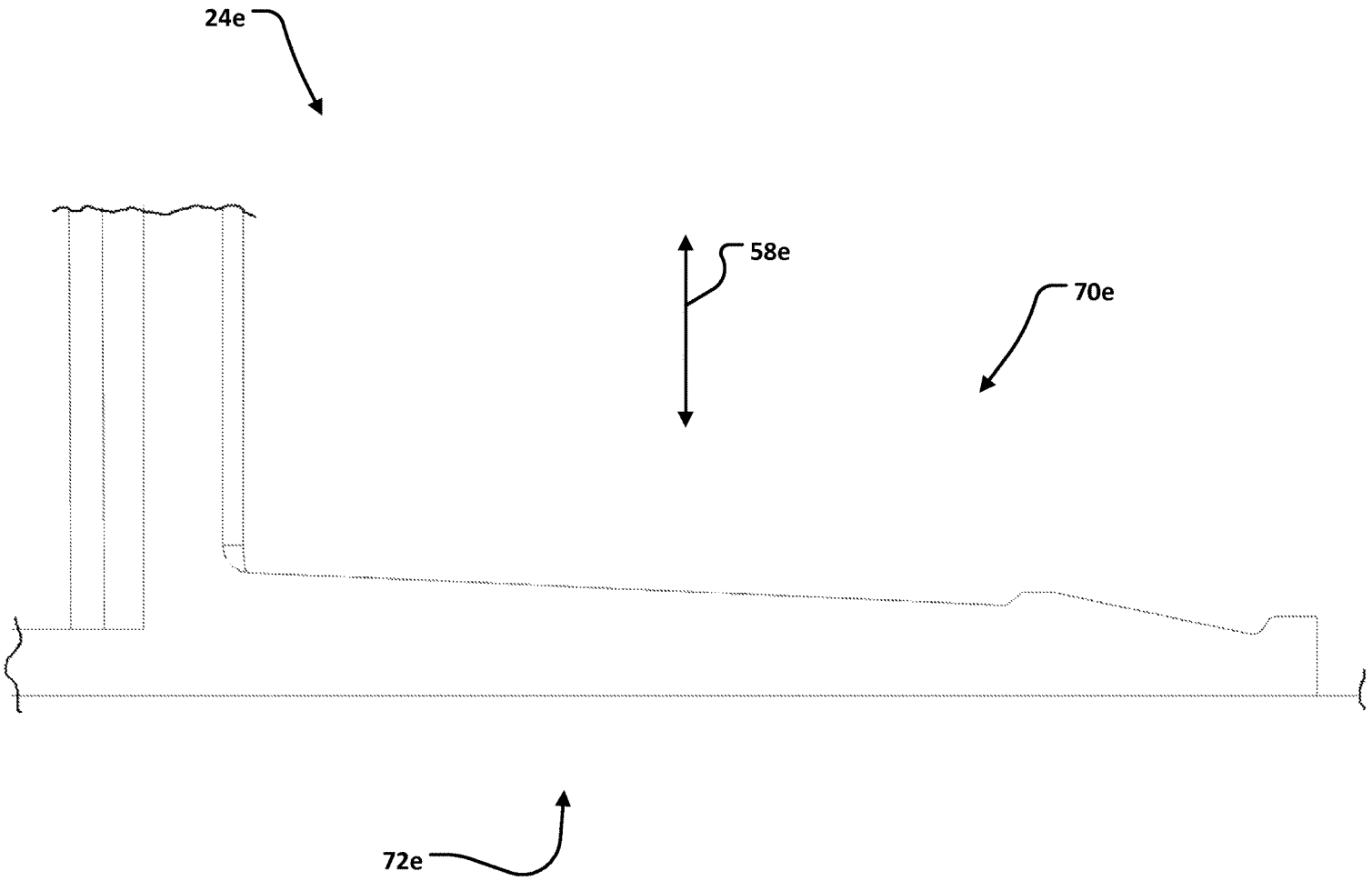
FIG. 11 is a planar view of a locking arm of another exemplary embodiment of the present disclosure.

FIG. 11 is a planar view of a locking arm 24*e* of another exemplary embodiment of the present disclosure from the perspective of a central longitudinal axis 58*e*. The locking arm 24*e* includes an upper face 70*e* and a lower face 72*e*. The upper face 70*e* defines a plurality of discreet planar surfaces with edges defined between the surfaces. The upper face 70*e* does not include protuberances but is longer than the upper face 70*c* and defines ramped surface portions of smaller slope that the ramp surface portions 392*c*, 492*c* of the upper face 70*c*. This profile can be desirable in that it provides a surface more amenable to infinite, stable positioning, since the posts cannot be positioned on the precise edges of protuberances and steep ramps can tend to urge the posts down the ramp surface.

Figure 12:
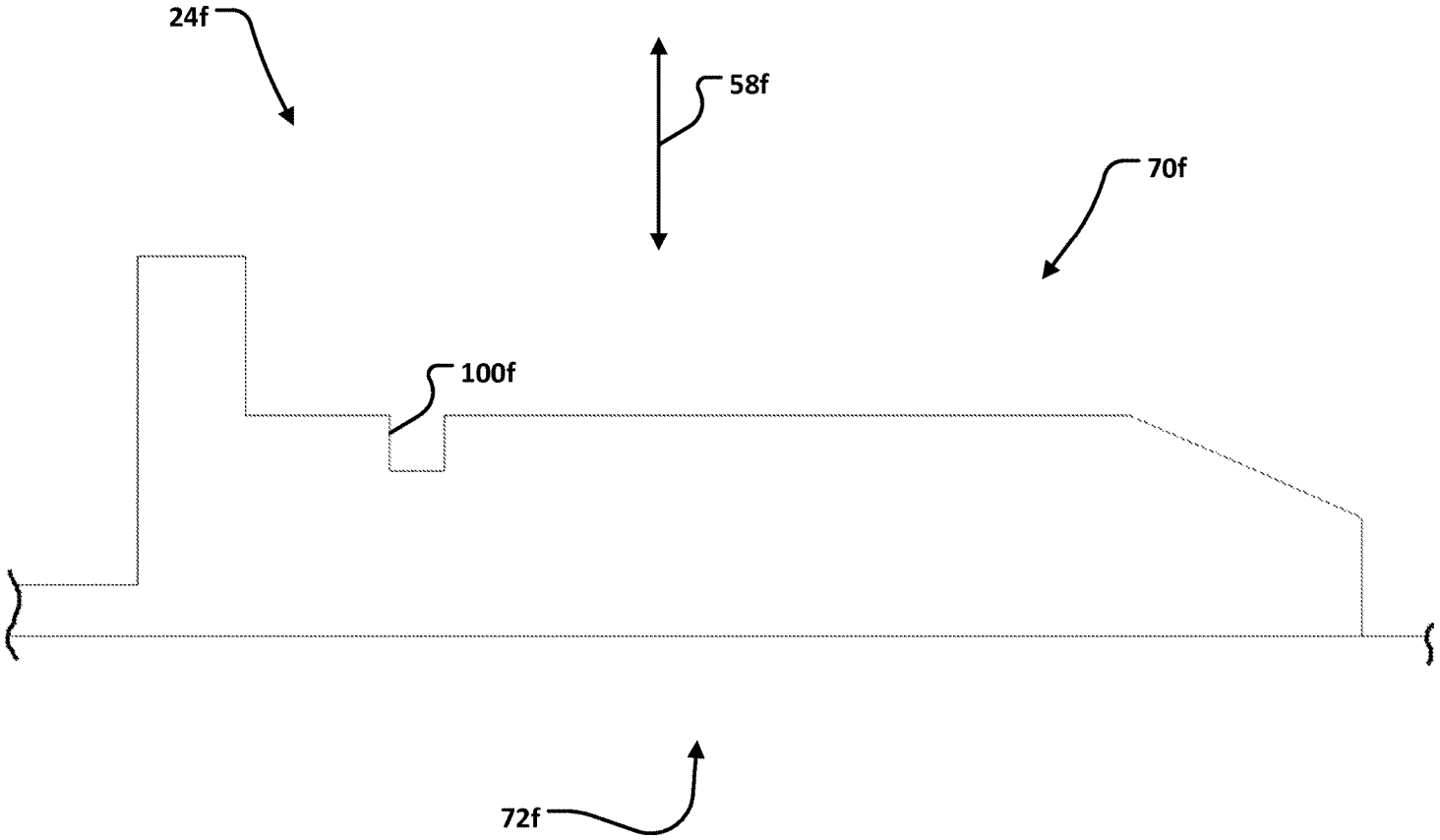
FIG. 12 is a planar view of a locking arm of another exemplary embodiment of the present disclosure.

FIG. 12 is a planar view of a locking arm 24*f* of another exemplary embodiment of the present disclosure from the perspective of a central longitudinal axis 58*f*. The locking arm 24*f* includes an upper face 70*f* and a lower face 72*f*. The upper face 70*f* defines a plurality of discreet planar surfaces with edges defined between the surfaces. The upper face 70*f* also defines a notch 100*f* for receiving and capturing a post.

Referring again to FIGS. 7-9, the exemplary posts 40*c* extend only radially outward from the axis 58*c*. Alternatively, the posts 40 of the embodiment show in FIGS. 1 and 2 extend in multiple directions relative to the axis 58. The posts 40 extend upward along the axis 58 a first predetermined distance and circumferentially a second predetermined distance about the axis 58.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or subcombinations that are disclosed herein as other present disclosures in other patent documents is hereby unconditionally reserved.

What is claimed is:

1. A lighting arrangement comprising:

a mounting ring extending along a central longitudinal axis and having a plurality of mounting apertures and a circular wall, said circular wall having an inwardly-facing surface encircling said central longitudinal axis and defining a cavity, said circular wall also having an outwardly-facing surface opposite said inwardly-facing surface with a thickness defined between said inwardly-facing surface and said outwardly-facing surface, said circular wall extending a height along said axis between a downwardly-facing surface and an upwardly-facing surface;

a luminaire having a housing assembly and a light emitter, said housing assembly at least partially enclosing said light emitter, said housing assembly at least partially received in said cavity;

a plurality of locking arms projecting from a first of said circular wall and said luminaire radially in a first direction relative to said central longitudinal axis, each of said plurality of locking arms including a vertical portion extending along said central longitudinal axis and a circumferential portion extending about said central longitudinal axis, each of said circumferential portions extending from a first end at an intersection with one of said vertical portions to a respective second end distal relative to said first end, and each of said circumferential portions having an upper face and a lower face;

a plurality of posts each extending away from a second of said circular wall and said luminaire radially in a second direction relative to said central longitudinal axis opposite to said first direction;

a plurality of protuberances and at least one planar surface portion between said plurality of protuberances projecting upward along said central longitudinal axis from at least one of said upper faces; and wherein said mounting ring and said luminaire are interconnected by moving at least one of said plurality posts past at least one of said plurality of distal ends along said central longitudinal axis and rotating said mounting ring and said luminaire relative to one another in a first angular direction about said central longitudinal axis and successively sliding said at least one of said plurality posts across a first of said plurality of protuberances, said at least one planar surface portion, and a second of said plurality of protuberances.

2. The lighting arrangement of claim 1 wherein said housing assembly further comprises:

a body portion extending between top and bottom ends along said central longitudinal axis; and a flange portion extending radially-outward from said body portion and having an upwardly-facing surface and a downwardly-facing surface, wherein said upwardly-facing surface of said flange portion abuts and contacts said downwardly-facing surface of said circular wall.

3. The lighting arrangement of claim 1 wherein at least one of said upper faces includes a plurality of surface portions that are convex relative to a second angular direction about said central longitudinal axis opposite to said first angular direction.

4. The lighting arrangement of claim 1 wherein said plurality of locking arms extend from said inwardly-facing surface of said circular wall.

5. The lighting arrangement of claim 1 wherein at least one of said lower faces defines a stepped profile.

6. The lighting arrangement of claim 1 wherein a thickness of said plurality of locking arms is defined along said central longitudinal axis and is variable.

7. The lighting arrangement of claim 1 wherein said plurality of posts extend only radially outward relative to said central longitudinal axis.

8. The lighting arrangement of claim 1 wherein said plurality of posts extend in multiple directions relative to said central longitudinal axis.

9. The lighting arrangement of claim 1 wherein a circumferential length of said planar surface is greater than a circumferential length of either of said first of said plurality of protuberances and said second of said plurality of protuberances.

10. The lighting arrangement of claim 2 wherein said upwardly-facing surface of said flange portion abuts and contacts said downwardly-facing surface of said circular wall around a continuous circumference about said central longitudinal axis.

11. The lighting arrangement of claim 2 wherein said housing assembly further comprises:

a canister portion positioned in said body portion, wherein said light emitter is disposed in said canister portion.

12. The lighting arrangement of claim 2 wherein said body portion has a variable thickness with thicker portions surrounding each of said plurality of posts.

13. The lighting arrangement of claim 10 wherein said body portion is fully disposed in said cavity.

14. The lighting arrangement of claim 13 wherein a diameter of said flange portion is substantially equal to a diameter of said outwardly-facing surface of said circular wall.

15. The lighting arrangement of claim 10 wherein said body portion extends along said central longitudinal axis between said downwardly-facing surface of said circular wall and said plurality of tabs.

16. The lighting arrangement of claim 11 wherein said canister portion and said body portion are interconnected with fasteners.

17. The lighting arrangement of claim 3 wherein said plurality of convex surface portions are shaped differently than said plurality of protuberances.

18. The lighting arrangement of claim 5 wherein said stepped profile further comprises a plurality of steps and a plurality of gaps between adjacent steps, where a circumferential width between said plurality of gaps is variable.

19. The lighting arrangement of claim 8 wherein said plurality of posts extend along said axis and circumferentially about said central longitudinal axis.

20. The lighting arrangement of claim 17 wherein at least one of said plurality of convex surface portions is positioned on said at least one of said upper faces spaced from said plurality of protuberances in the second angular direction about said central longitudinal axis.

* * * * *